US007918764B2

(12) United States Patent
VanElverdinghe

(10) Patent No.: US 7,918,764 B2
(45) Date of Patent: Apr. 5, 2011

(54) PANEL-TYPE FRAME STRUCTURE FOR A RECREATIONAL STRUCTURE

(76) Inventor: Jeffry L. VanElverdinghe, Beaverton, OR (US)

( * ) Notice: Subject to any disclaimer, the term of this patent is extended or adjusted under 35 U.S.C. 154(b) by 0 days.

(21) Appl. No.: 11/970,412

(22) Filed: Jan. 7, 2008

(65) Prior Publication Data

US 2009/0062077 A1 Mar. 5, 2009

Related U.S. Application Data

(60) Provisional application No. 60/969,586, filed on Aug. 31, 2007.

(51) Int. Cl.
*A63B 5/11* (2006.01)

(52) U.S. Cl. ..... 482/27; 482/29

(58) Field of Classification Search ..... 482/27, 482/28, 29, 30, 31, 32, 35, 36, 37; 52/169.7, 52/169.9, 741.13
See application file for complete search history.

(56) References Cited

U.S. PATENT DOCUMENTS

| | | | | |
|---|---|---|---|---|
| 2,324,970 | A * | 7/1943 | Woolley | 482/29 |
| 3,075,764 | A | 1/1963 | DeLorean | |
| 3,130,816 | A | 4/1964 | Wright | |
| 3,276,544 | A | 10/1966 | Hall | |
| 3,317,927 | A * | 5/1967 | Shields | 52/245 |
| 3,367,661 | A | 2/1968 | Dean, Jr. | |
| 3,501,141 | A | 3/1970 | Nissen et al. | |
| 3,635,471 | A | 1/1972 | Caron | |
| 3,648,301 | A * | 3/1972 | Wiley | 52/169.7 |
| 3,648,303 | A * | 3/1972 | Stewart et al. | 52/5 |
| 3,959,830 | A * | 6/1976 | van den Broek | 52/287.1 |
| 4,182,087 | A * | 1/1980 | Schall et al. | 52/169.7 |
| 4,223,498 | A * | 9/1980 | Ventrice | 52/249 |
| 4,303,226 | A * | 12/1981 | Powell et al. | 256/25 |
| 4,336,933 | A * | 6/1982 | Appelbaum | 482/8 |
| 4,623,126 | A * | 11/1986 | Pettit | 256/25 |
| 5,299,989 | A * | 4/1994 | Boyd et al. | 482/27 |
| D353,866 | S | 12/1994 | Houry et al. | |
| D353,867 | S | 12/1994 | Houry et al. | |
| 5,370,591 | A | 12/1994 | Jewell et al. | |
| D354,108 | S | 1/1995 | Houry et al. | |
| D358,441 | S | 5/1995 | Houry et al. | |
| 5,462,505 | A * | 10/1995 | Blair et al. | 482/27 |
| D367,308 | S | 2/1996 | Kelley et al. | |
| 5,592,702 | A * | 1/1997 | Gillebaard, Jr. | 4/506 |
| 5,624,122 | A | 4/1997 | Winkelhorn | |

(Continued)

FOREIGN PATENT DOCUMENTS

EP 0107456 5/1984

(Continued)

*Primary Examiner* — Loan Thanh
*Assistant Examiner* — Daniel F Roland
(74) *Attorney, Agent, or Firm* — Joseph P. Curtin, L.L.C.

(57) ABSTRACT

A recreational structure comprises a rebounding-surface frame forming a closed shape, and at least one panel disposed between the rebounding-surface frame and a support surface. The at least one comprises a horizontal edge, and at least a portion of the top horizontal edge of at the least one panel is coupled to at least a portion of the rebounding-surface frame. In one exemplary embodiment, at least a first and a second panel each comprise first and second vertical edges and a horizontal edge. The first vertical edge of the first panel is coupled to a second vertical edge of the second panel. At least a portion of the top horizontal edge of at least one of the first and second panels is coupled to at least a portion of the rebounding-surface frame.

4 Claims, 12 Drawing Sheets

U.S. PATENT DOCUMENTS

| | | | | |
|---|---|---|---|---|
| D381,730 | S | 7/1997 | van Huystee | |
| 5,713,085 | A * | 2/1998 | Enns | 4/506 |
| 6,071,213 | A * | 6/2000 | Raasch et al. | 482/29 |
| 6,093,134 | A * | 7/2000 | Worsham | 482/35 |
| D430,255 | S | 8/2000 | Yates et al. | |
| D432,616 | S | 10/2000 | Yates et al. | |
| 6,135,922 | A * | 10/2000 | Nissen | 482/27 |
| 6,216,410 | B1 * | 4/2001 | Haberman | 52/591.1 |
| 6,450,187 | B1 | 9/2002 | Lin et al. | |
| 7,691,032 | B2 * | 4/2010 | Burnham et al. | 482/29 |
| 2004/0176214 | A1 * | 9/2004 | Yueh | 482/27 |
| 2005/0054485 | A1 | 3/2005 | McDermott et al. | |
| 2006/0258509 | A1 | 11/2006 | Adams et al. | |
| 2006/0258510 | A1 | 11/2006 | McGee et al. | |
| 2006/0270525 | A1 * | 11/2006 | Colling | 482/27 |
| 2006/0272230 | A1 * | 12/2006 | Elwood | 52/182 |
| 2008/0081739 | A1 | 4/2008 | Burnham et al. | |
| 2009/0062077 | A1 * | 3/2009 | VanElverdinghe | 482/27 |

FOREIGN PATENT DOCUMENTS

| | | | |
|---|---|---|---|
| WO | WO 9316762 | A1 * | 9/1993 |

* cited by examiner

PANEL-TYPE FRAME STRUCTURE FOR A RECREATIONAL STRUCTURE

CROSS-REFERENCE TO RELATED PATENT APPLICATION

The present patent application claims priority to U.S. Provisional Patent Application No. 60/969,586, filed on Aug. 31, 2007, the disclosure of which is herein incorporated by reference in its entirety.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

The word "exemplary" is used herein to mean "serving as an example, instance, or illustration." Any embodiment described herein as "exemplary" is not to be construed as necessarily preferred or advantageous over other embodiments.

Figure 1A:
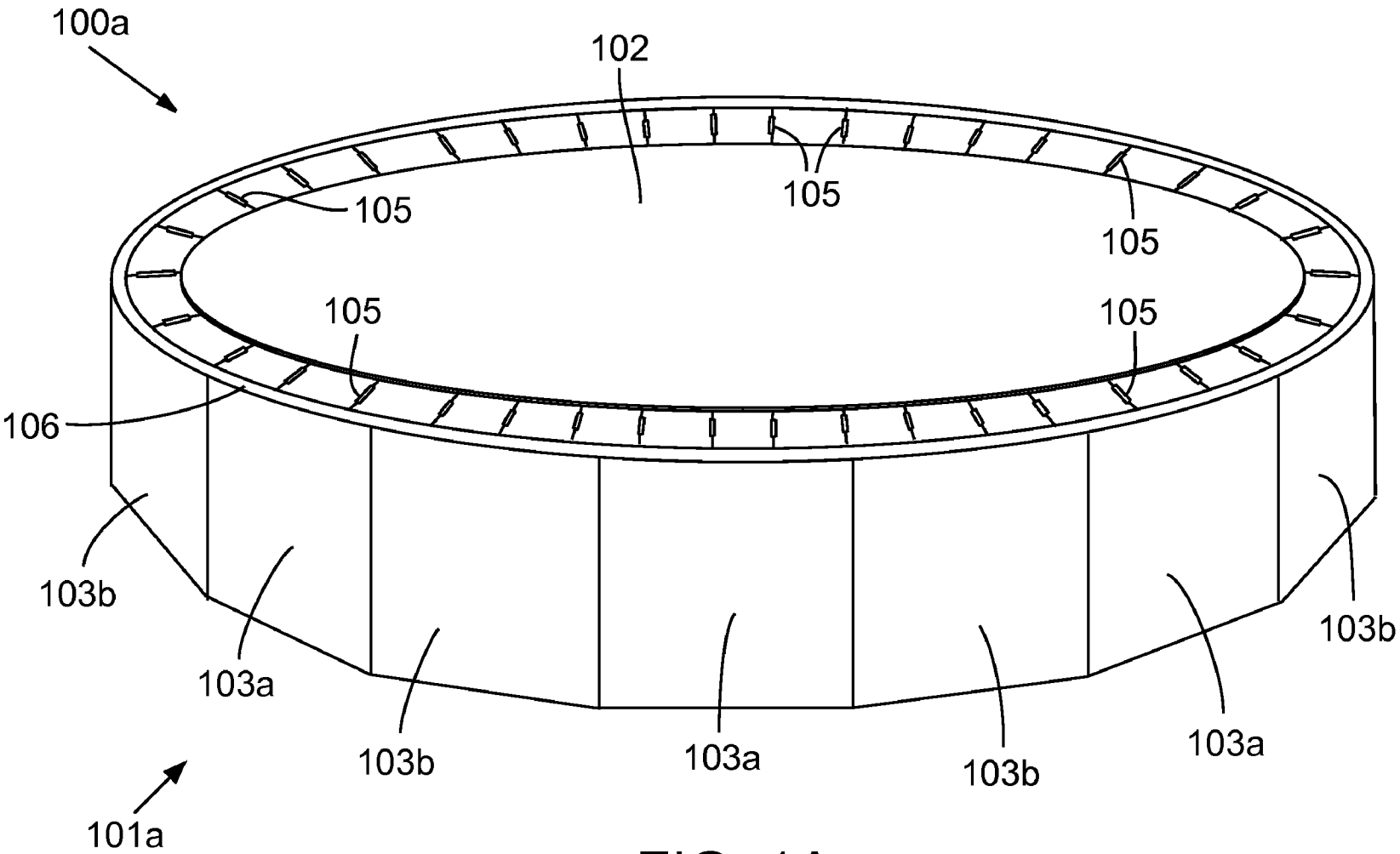
FIGS. 1A and 1B depict exemplary embodiments of a recreational structure comprising a panel base that does not require leg poles for providing physical support for a rebounding surface according to the subject matter disclosed herein.
Figure 1B:
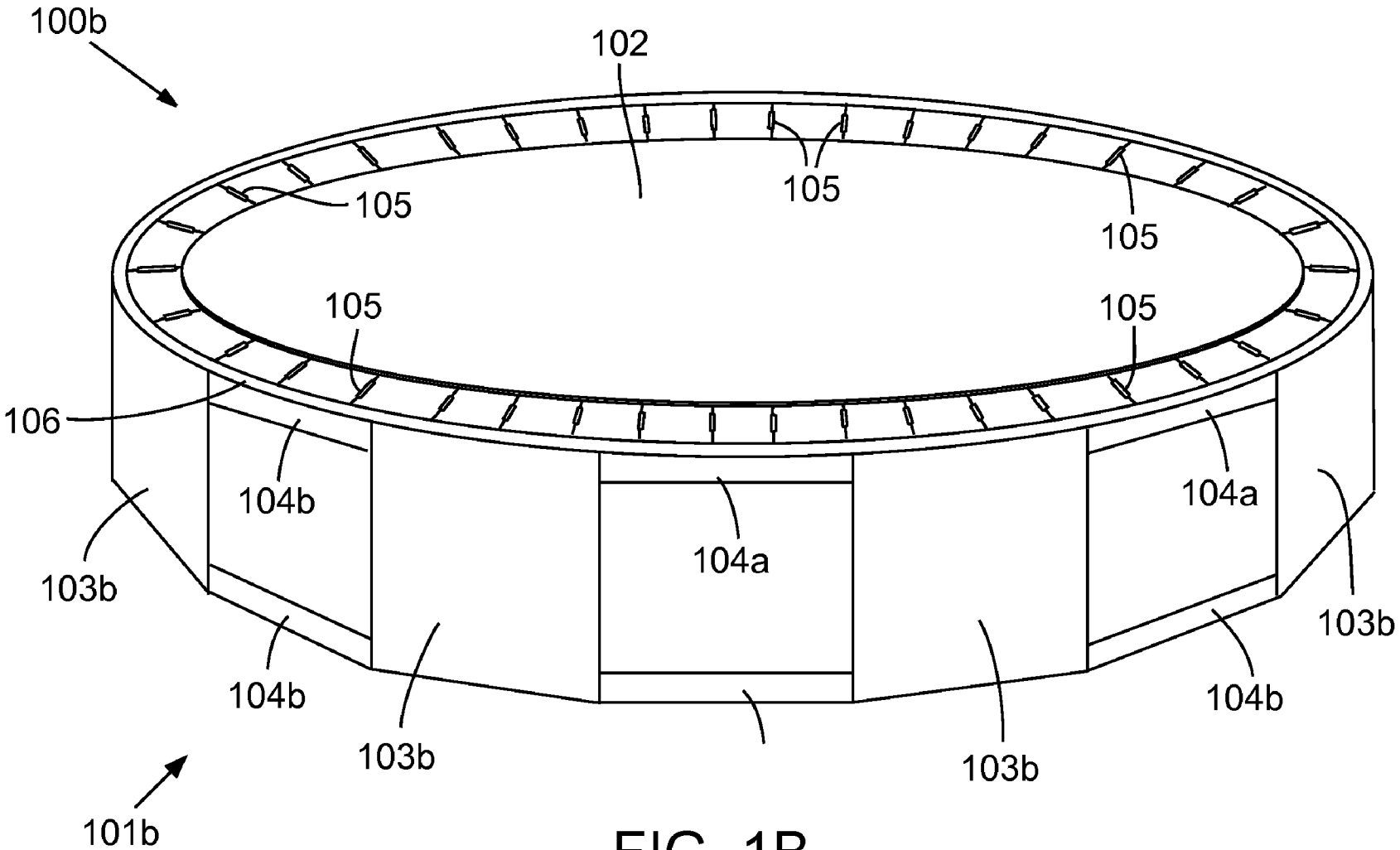

FIG. 1A depicts one exemplary embodiment of a recreational structure 100*a* comprising a panel base 101*a* that does not require leg poles for providing physical support for a rebounding surface 102 of, for example, a trampoline. FIG. 1B depicts another exemplary embodiment of a recreational structure 100*b* comprising a panel base 101*b* that does not require leg poles for providing physical support for a rebounding surface 102 of, for example, a trampoline.

In FIG. 1A, panel base 101*a* comprises a plurality of panels 103*a* that are arranged into a desired shape (as viewed from above), such as a regular polygonal shape, that, in one exemplary embodiment, approximates a circle. Panels 103*a* are disposed between a rebounding-surface frame 106 and a support surface (not shown), such as the ground or a floor. Accordingly, for the particular exemplary embodiment shown in FIG. 1A, as more panels 103*a* are used to form the regular polygonal shape, the approximation to a circle becomes better. In another exemplary embodiment, the polygonal shape can approximate an oval. Other polygonal shapes that can be formed using panels 103*a* include, but are not limited to, squares and rectangles. A panel 103*a* comprises a substantially rigid panel that may be formed of, but is not limited to, plastic, aluminum, steel, a metal-based alloy, a monocoque carbon fiber, and/or wood. It should be understood that a panel 103*a* could be formed from any material capable of withstanding, for example, the shear, tension, compression, torsional and load stresses that are experienced by a structure such as recreational structure 100*a*.

In one exemplary embodiment, a recreational structure bed frame 106 is disposed on and is supported by panel base 101 and is coupled to rebounding surface 102. Rebounding surface 102 is coupled to the trampoline bed frame using, for example, springs 105, of which only a few are indicated for clarity. Other techniques that could be used for coupling rebounding surface 102 to the trampoline bed frame include, but are not limited to, elastic straps, bungee-type cords, torsion rods and/or flexible rods.

In FIG. 1B, panel base 101*b* comprises a plurality of panels 103*b* and sections 104 that are arranged into a desired shape (as viewed from above), such as a regular polygonal shape, that, in one exemplary embodiment, approximates a circle. Panels 103*b* are disposed between a rebounding-surface frame 106 and a support surface (not shown), such as the ground or a floor. Accordingly, for the particular exemplary embodiment shown in FIG. 1B, as more panels 103*b* and sections 104 are used to form the regular polygonal shape, the approximation to a circle becomes better. One exemplary embodiment of a section 104 comprises an upper section 104*a* and a lower section 104*b* that are coupled on both sides to adjacent panels 103*b*. Another exemplary embodiment of a section 104 comprises only an upper section 104*a*. Still another exemplary embodiment of a section 104 comprises only a lower section 104*b*. In another exemplary embodiment, the polygonal shape can be arranged to approximate an oval. Other polygonal shapes that can be formed using panels 103*b* and sections 104 include, but are not limited to, squares and rectangles. Panels 103*b*, upper sections 104*a* and lower sections 104*b* comprise a substantially rigid panel that may be formed of, but is not limited to, plastic, aluminum, steel, a metal-based alloy, a monocoque carbon fiber, and wood. It should be understood that a panel 103*b*, an upper section 104*a* and a lower section 104*b* could be formed from any material capable of withstanding, for example, the shear, tension, compression, torsional and load stresses that are experienced by a structure such as recreational structure 100*b*.

Figure 2A:
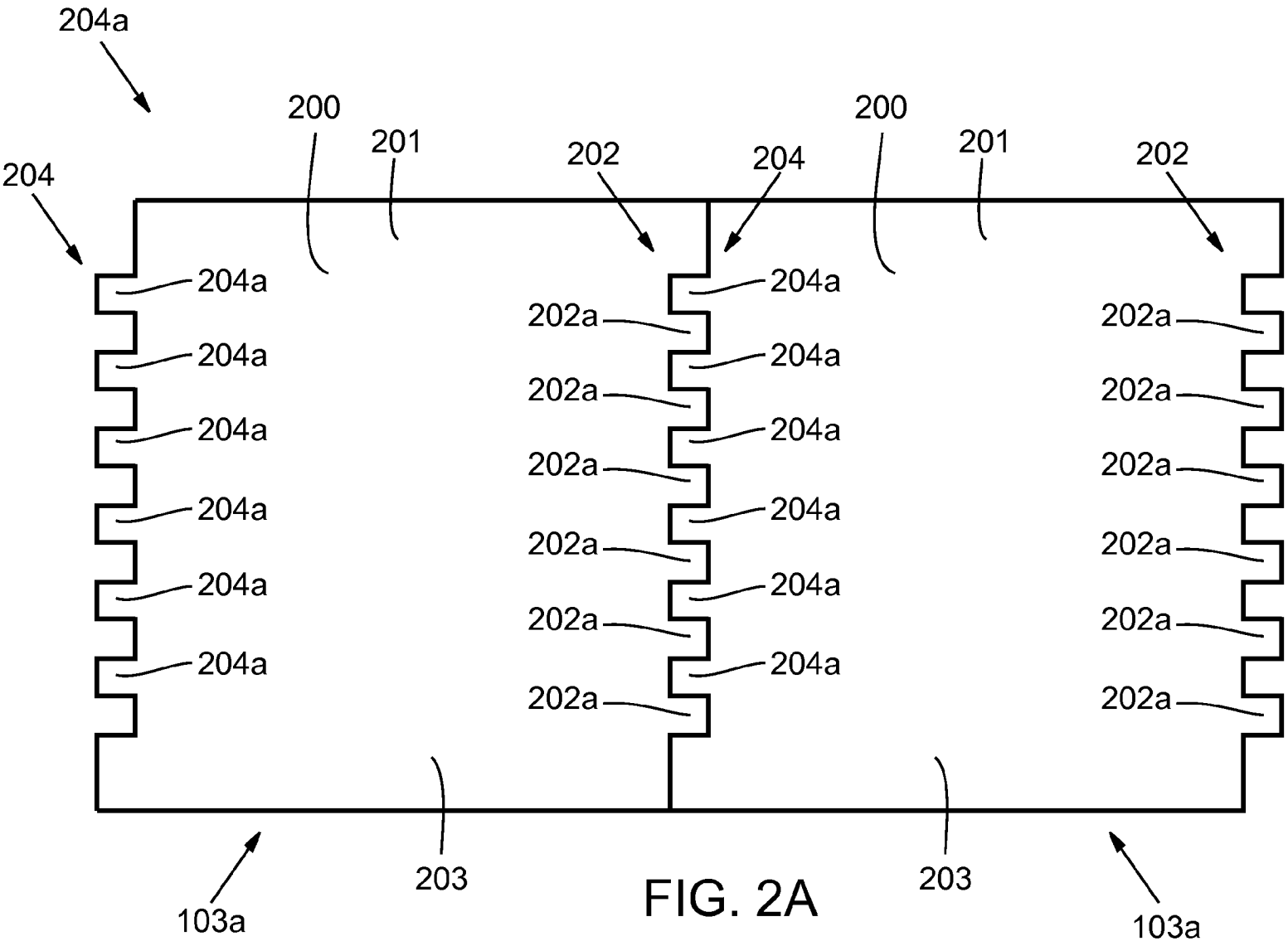
FIG. 2A depicts two adjacent exemplary panels that form a portion of a panel base according to the subject matter disclosed herein.

FIG. 2A depicts two adjacent exemplary panels 103*a* that form a portion of a panel base 101*a* according to the subject matter disclosed herein. As depicted in FIG. 2A, a panel 103*a* comprises a panel body 200, a top edge 201, a right-side edge 202, a bottom edge 203 and a left-side edge 204. A right-side edge 202 of a panel 103*a* is configured to engage with a left-side edge 204 of an adjacent panel 103*a* (i.e., the left-side edge of a panel to the right). Similarly, a left-side edge 204 is configured to engage with a right-side edge of an adjacent panel 103*a* (i.e., the right-side edge of a panel to the left). In one exemplary embodiment, right-side edge 202 comprises a plurality of extensions, or tab members, 202*a* that project from the right-side edge of the panel, and left-side edge 204 comprises a corresponding plurality of extensions, or tab members, 204*a* that project from the left-side edge of the panel. Tab members 202*a* and 204*a* are configured to interdigitate with each other. In one exemplary embodiment, tab members 202*a* and 204*a* fit together relatively tightly, such as shown in FIG. 2A. In another exemplary embodiment tab members 202*a* and 204*a* fit together with spaces between the adjacent tab members. In yet another exemplary embodiment, tab members 202*a* and 204*a* project from their respective edges of a panel substantially along the entire length of the edge. In still another contrasting exemplary embodiment, tab members 202*a* and 204*a* project from their respective edges of a panel at only selected locations along the edge, such as would be the case for a panel 103*b*, which couples to an upper section 104*a* and/or a lower section 104*b* (FIG. 1B). In a further exemplary embodiment, tab members 202*a* and 204*a* could be configured that that they fit together in a dovetail-joint manner.

Figure 2B:
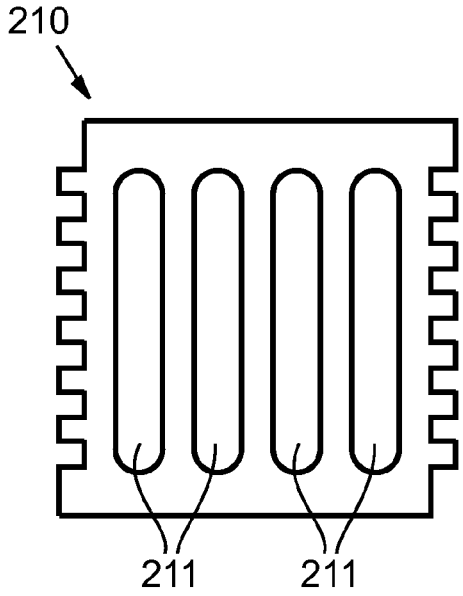
FIGS. 2B-2H depict a variety of different embodiments of a panel according to the subject matter disclosed herein.
Figure 2C:
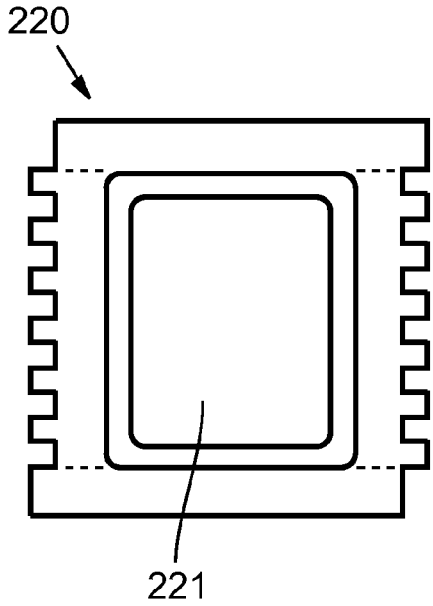
Figure 2D:
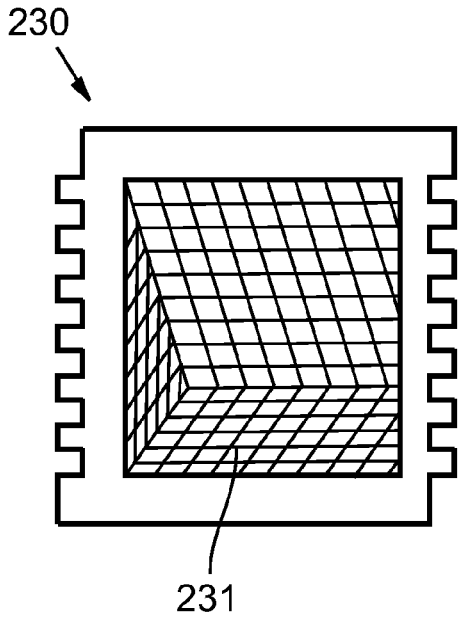
Figure 2E:
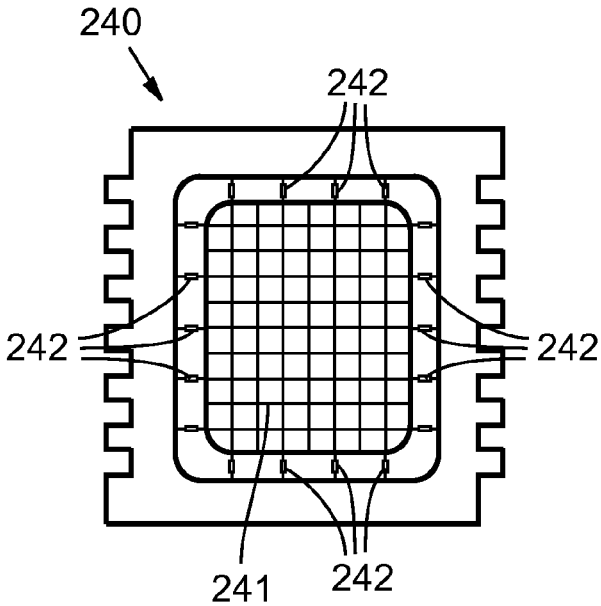
Figure 2F:
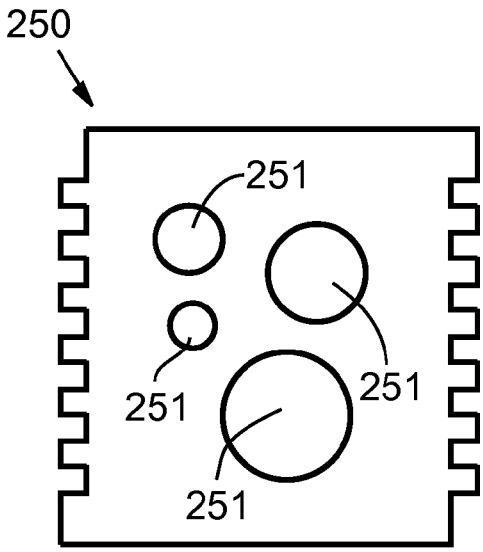
Figure 2G:
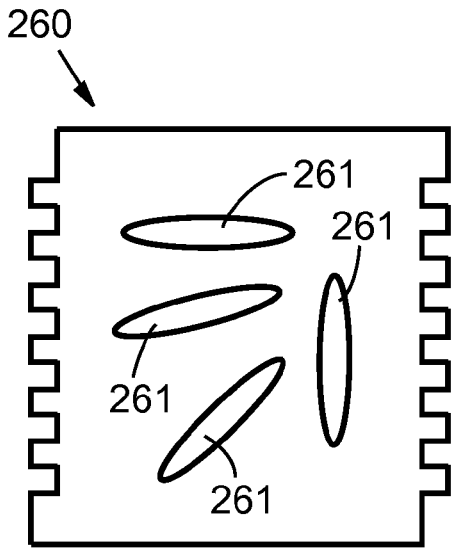
Figure 2H:
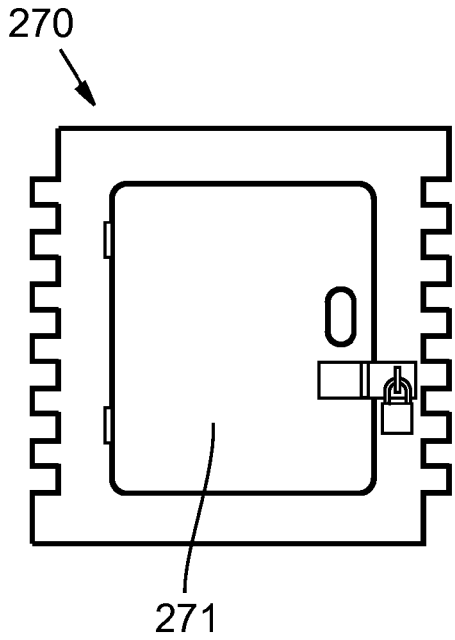

Panel body 200 can comprise a variety of different configurations, of which several selected exemplary embodiments are depicted in FIGS. 2B-2H. More specifically, FIG. 2B depicts a first exemplary embodiment 210 of a panel that comprises vent openings 211. While vent openings 211 are depicted as being vertically oriented oval-shaped apertures, it should be understood that vent openings 211 could be configured to be any orientation, shape and/or number. FIG. 2C depicts a second exemplary embodiment 220 of a panel that comprises a transparent panel insert 221. One alternative embodiment provides an aperture 221 that is capable of receiving an accessory including, but not limited to, a panel insert that is translucent or opaque. FIG. 2D depicts a third exemplary embodiment 230 of a panel that comprises an exemplary goalie's net 231 that extends behind panel 230 as viewed in FIG. 2D. FIG. 2E depicts a fourth exemplary embodiment 240 of a panel comprising a mesh- or netting-type of material forming rebounder surface 241 that is coupled to panel 240 in a well-known manner, such as by springs or bungee-type cords 242. FIG. 2F depicts a fifth exemplary embodiment 250 comprising a plurality of apertures 251 forming a throw-and-return system. The throw-and-return system could comprise a pipe-type routing system positioned behind panel 250 that directs a ball to be returned in a well-known manner through a selected aperture 251 after the ball has been thrown into any of the other apertures 251. It should be understood that apertures 251 could have a variety of shapes and sizes. Alternatively, apertures 251 of the fifth exemplary embodiment 250 could form a catch-and-hold system. FIG. 2G depicts a sixth exemplary embodiment 260 that comprises a plurality of oval-shaped apertures 261 for a flying disk targeting game. FIG. 2H depicts a seventh exemplary embodiment of a panel 270 comprising a lockable door 271 that provides secure access to an area below, for example, a rebounding surface 103 (FIG. 1). It should be understood that exemplary panel configuration are not limited to the exemplary embodiments depicted in FIGS. 2A-2H.

Figure 2I:
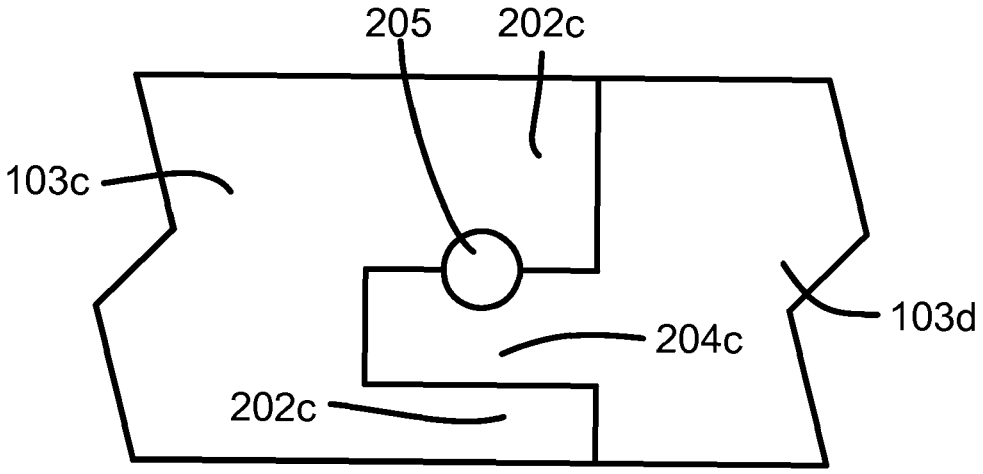
FIGS. 2I-2K depict top views of exemplary alternative configurations of extension members that could be used for engaging two adjacent panels or for engaging sections to a panel.
Figure 2J:
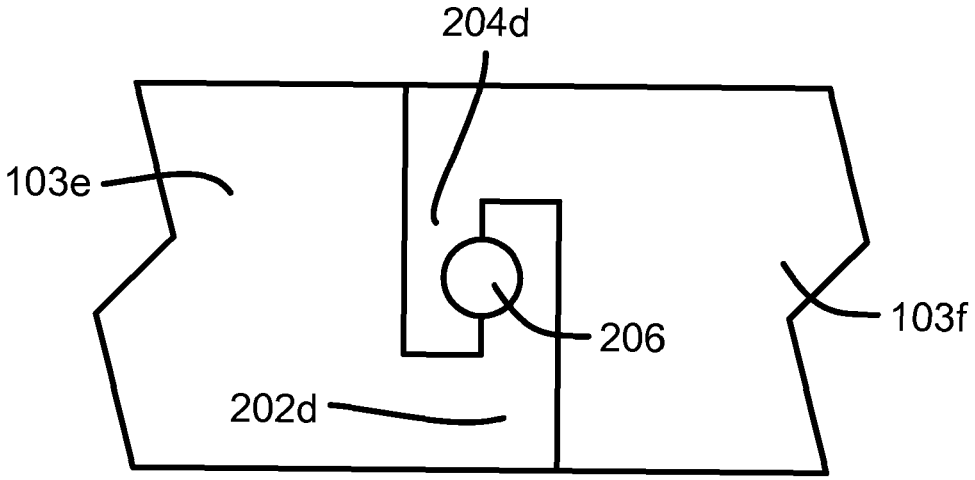
Figure 2K:
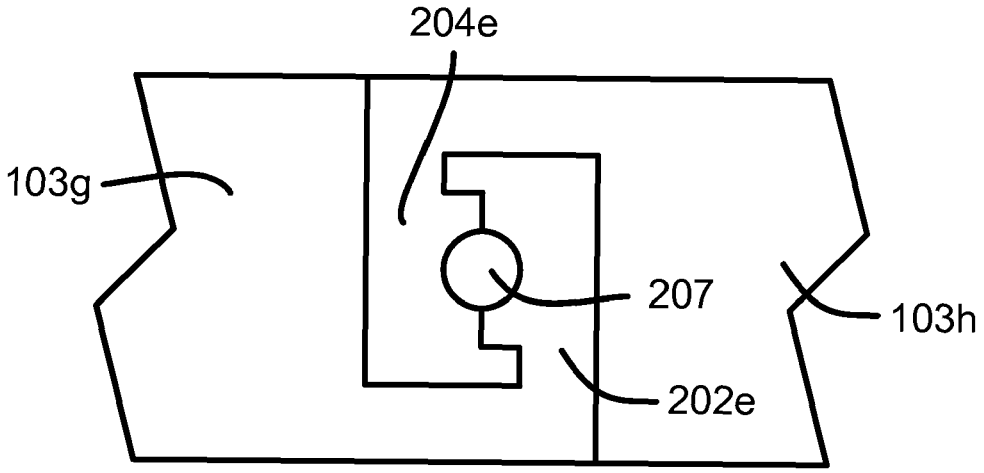

FIGS. 2I-2K depict top views of exemplary alternative configurations of extension members that could be used for engaging two adjacent panels 103 or for engaging sections 104 to a panel 103. In FIG. 2I, panels 103*c* and 103*d* respectively comprise extension members 202*c* and 204*c* that form a classic tongue-in-groove engagement configuration. When extension members 202*c* and 204*c* are fitted together, an aperture 205 is formed that is capable of receiving a pin member (not shown) that holds panels 103*c* and 103*d* together. In FIG. 2J, panels 103*e* and 103*f* respectively comprise extension members 202*d* and 204*d* than form an engagement configuration when fitted together. When extension members 202*d* and 204*d* are fitted together, an aperture 206 is formed that is capable of receiving a pin member (not shown) that holds panels 103*e* and 103*f* together. In FIG. 2K, panels 103*g* and 103*h* respectively comprise extension members 202*e* and 204*e* than form an engagement configuration when fitted together. When extension members 202*e* and 204*e* are fitted together, an aperture 207 is formed that is capable of receiving a pin member (not shown) that holds panels 103*g* and 103*h* together. It should be understood that the alternative configurations depicted in FIGS. 2I-2K could be used in conjunction with the exemplary extension members 202*a* and 204*a* depicted in FIG. 2A. Further, it should be understood that the alternative configurations depicted in FIGS. 2I-2K could project from their respective edges of a panel substantially along the entire length of the edge. In still another contrasting exemplary embodiment, the alternative configuration extension members could project from their respective edges of a panel at only selected locations along the edge, such as would be the case for a panel 103*b*, which couples to an upper section 104*a* and/or a lower section 104*b* (FIG. 1B).

Figure 3A:
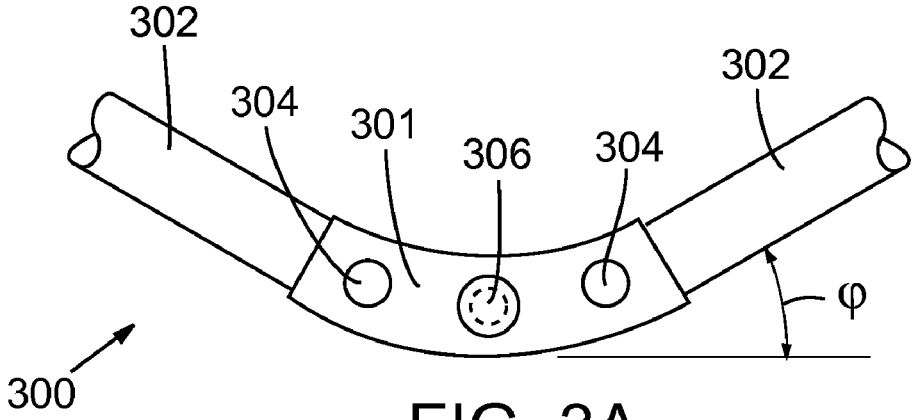
FIGS. 3A and 3B respectively depict top and side views of an exemplary embodiment of a portion of recreational structure frame according to the subject matter disclosed herein.
Figure 3B:
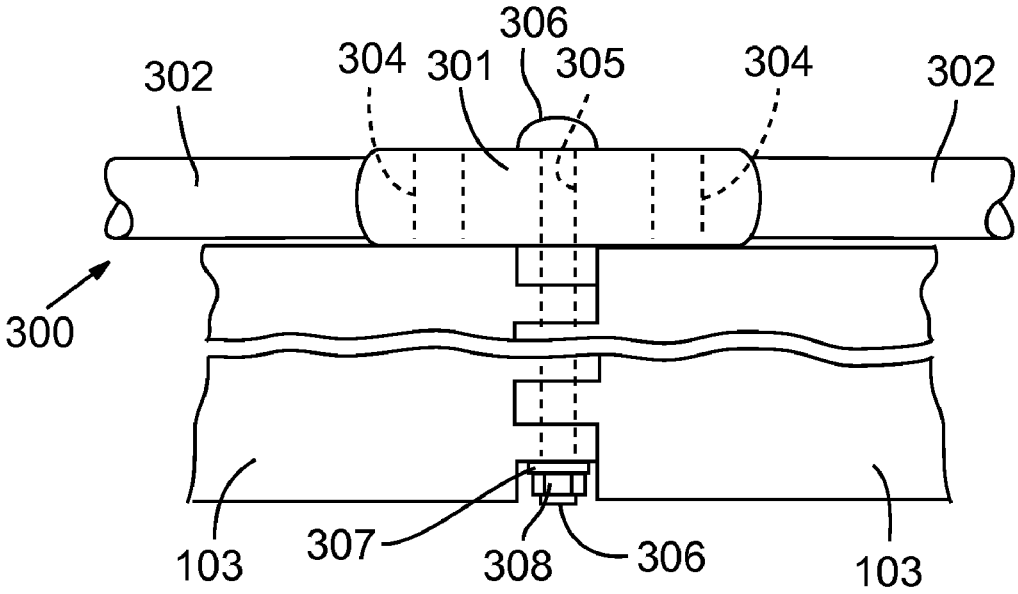

FIGS. 3A and 3B respectively depict top and side views of an exemplary embodiment of a portion of recreational structure frame 300. In particular, FIG. 3A depicts a top view of one exemplary embodiment of an angled-sleeve-joint coupling 301 into which frame members 302 of frame 300 are inserted. The angle $\phi$ shown in FIG. 3A varies depending on desired polygonal shape of frame 300. For example, when the desired polygonal shape is an octagon, angle $\phi$ is 45°. When the desired polygonal shape is a regular sixteen-sided polygon, angle $\phi$ is 22.5°. FIG. 3B depicts a side view of a portion of recreational structure frame 300 and a portion of two adjacent panels 103.

In one exemplary embodiment, frame members 302 are fitted together using angled-sleeve-joint couplings 301 to form a frame comprising polygonal shape that corresponds to the polygonal shape formed by a plurality of panels 103 (and sections 104). In another exemplary embodiment, frame members 302 are fitted together with angled-sleeve-joint couplings 301 and straight-sleeve-joint couplings 303 to form a frame comprising a polygonal shape that corresponds to the polygonal shape formed by a plurality of panels 103 (and sections 104). For example, the polygonal shape of recreational frame structure 300, shown in FIG. 3D, corresponds to the polygonal shape formed by a plurality of panels (not shown in FIG. 3D) in which one panel corresponds to each frame member 302. In another exemplary embodiment, one panel corresponds to the two frame members that span between two adjacent angled-sleeve-joint couplings 301. In one exemplary embodiment, a sleeve-joint coupling 301, 303 fits around a frame member 302 in a well-known manner as a frame member 302 is inserted into a sleeve-joint coupling 301, 303. In another exemplary embodiment, a frame member 302 fits around a sleeve-joint coupling 301, 303 in a well-known manner. In still another exemplary embodiment, a frame member 302 comprises one or more apertures (not shown) capable of receiving a pin that is used for locating frame 303 in a correct position with respect to a panel, that is, the pin extends through the aperture into a corresponding aperture in a panel.

As shown in FIGS. 3A and 3B, angled sleeve-joint coupling 301 comprises apertures 304, which are each configured for accepting an enclosure pole, and an aperture 305, which is configured for accepting a carriage pin 306. Carriage pin 306 extends through an aperture (not shown) formed in each of tab members 202*a* and 204*a* when tab members 202*a* and 204*a* are interdigitated. A straight sleeve-joint coupling 303 is configured similarly to angled-sleeve-joint coupling, but is straight rather than comprising an angle ϕ. A washer 307 is positioned and nut 308 is threaded onto carriage pin 305 in a well-known manner. While one carriage pin 306 is shown in FIG. 3B that extends between the top and bottom edges of a panel, it should be understood that a plurality of carriage pins could be used along the joining edges of a panel 103, such as when a panel 103*b* is coupled to upper and/or lower sections 104*a*, 104*b*.

Figure 3C:
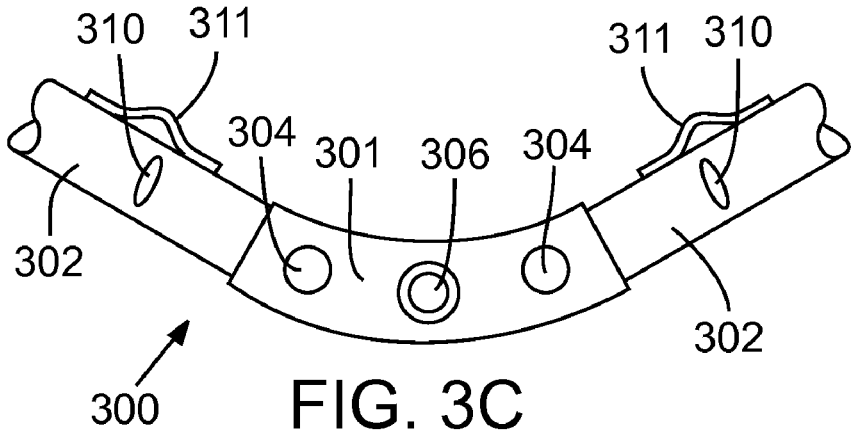
FIG. 3C depicts two alternative configurations for coupling a spring member to recreational structure frame according to the subject matter disclosed herein.

FIG. 3C depicts two alternative configurations for coupling a spring 105 (FIGS. 1 and 3D) to recreational structure frame 300. One exemplary embodiment provides apertures 310 that are configured along a top side of frame 300 to accept the hook portion of a spring. An alternative embodiment provides apertures 310 arranged in an alternating manner along the top and bottom sides of a frame 300, such as disclosed by U.S. Patent Application Publication Nos. 2006//0258509 A1 to Adams and 2006/0258510 A1 to McGee, the disclosures of each being incorporated by reference herein. Another exemplary embodiment provides spring-attachment members 311 that are attached to a frame member 302 in a well-known manner, such as by welding. Spring-attachment members 311 are configured to accept the hook portion of a spring in the space formed between frame member 302 and the spring-attachment member 311.

Figure 3D:
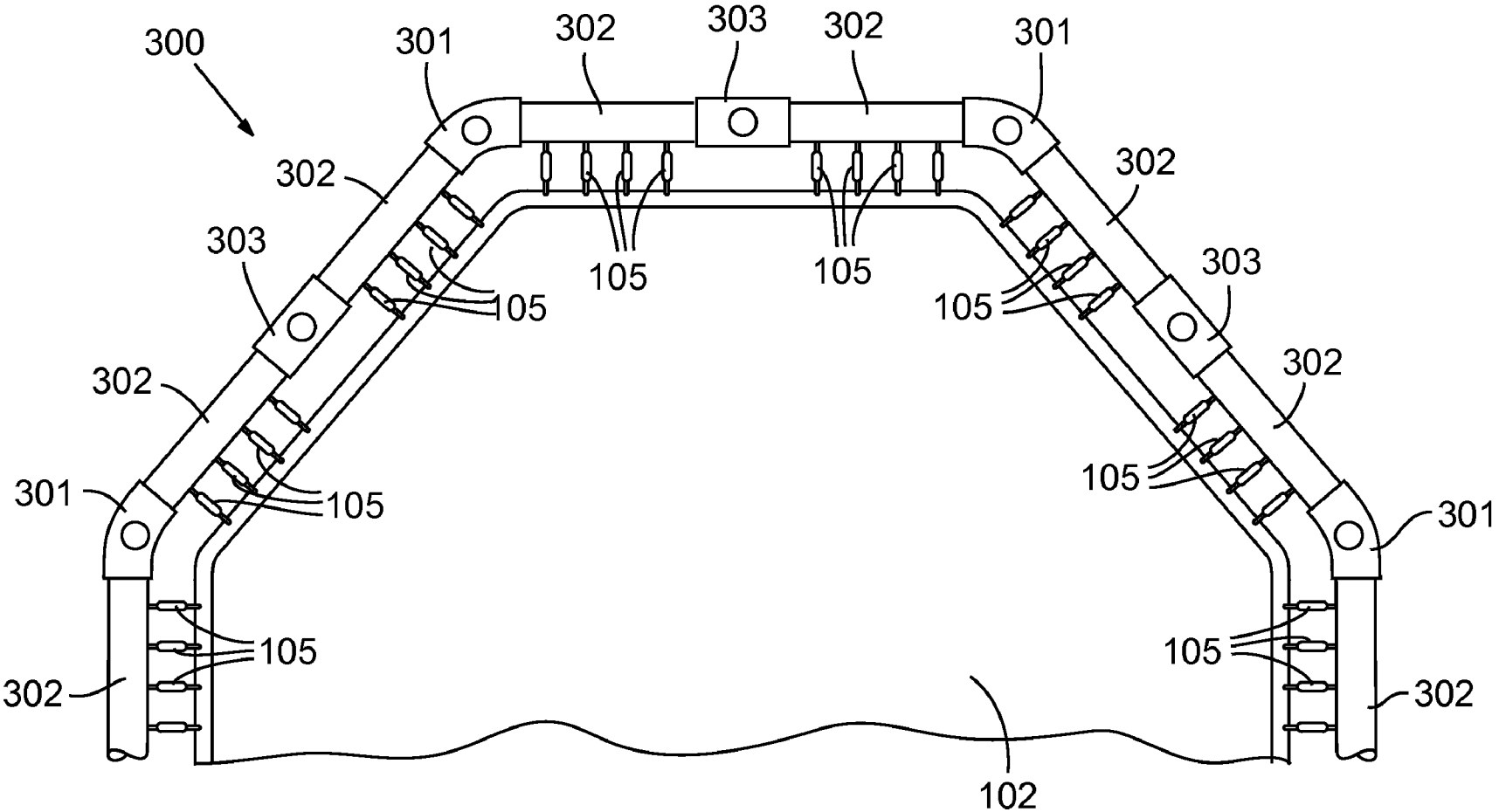
FIGS. 3D-3F depict exemplary shapes of a portion of a frame with respect to an exemplary polygonal shape of a portion of a panel base according to the subject matter disclosed herein.
Figure 3E:
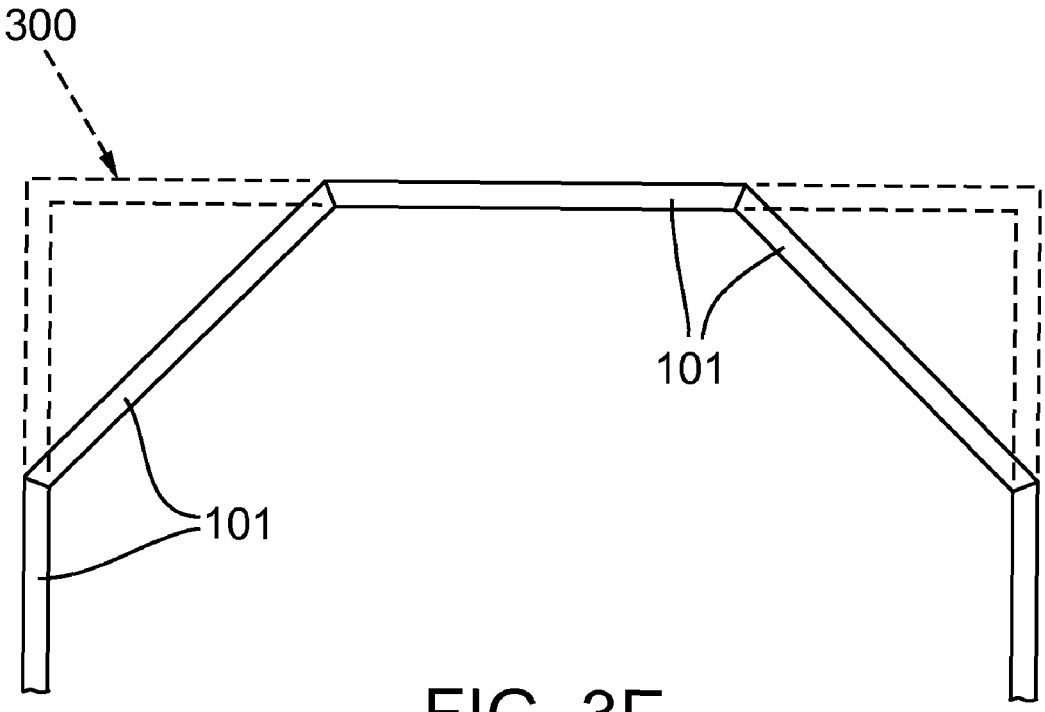
Figure 3F:
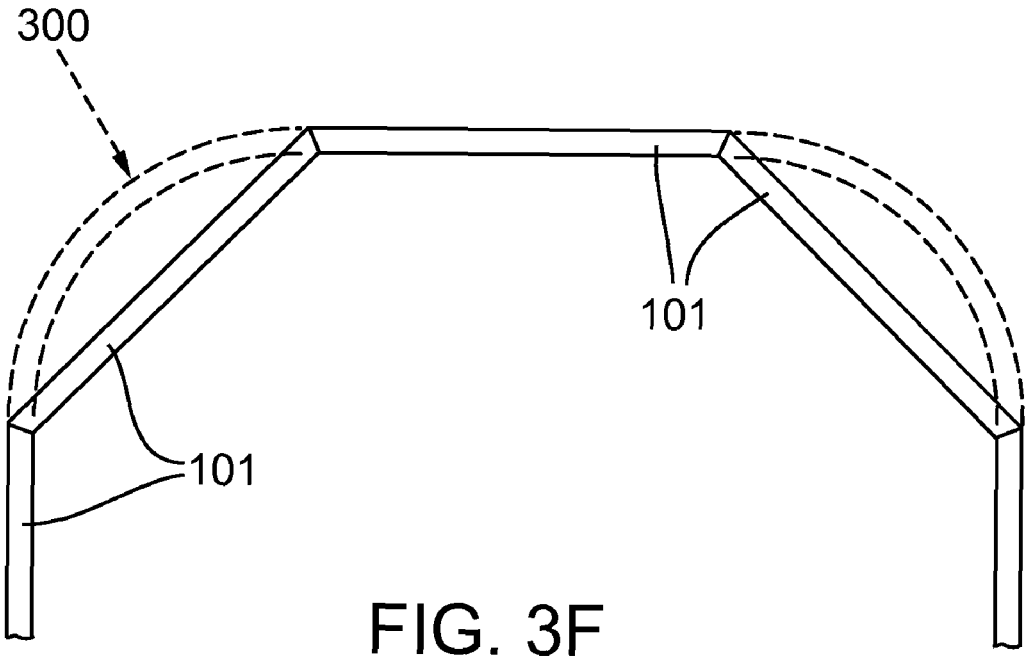

FIG. 3D shows an exemplary polygonal shape of a portion of a frame 300 in which frame 300 corresponds to a portion of the polygonal shape formed by the panel base. FIG. 3E shows an exemplary polygonal shape of a portion of a frame 300 superimposed on a portion of a panel base 101 in which frame 300 has a polygonal shape that differs from the polygonal shape formed by the panel base 101. In particular, FIG. 3E shows the shape of a portion of a frame 300, which is depicted by a dashed line, to be a shape that is different from a corresponding portion of panel base 101, which is depicted by a solid line. FIG. 3F shows an exemplary shape of at least a portion of a frame 300 superimposed on a portion of a panel base 101 in which frame 300 has a shape that is different from the polygonal shape formed by a corresponding portion of panel base 101. In particular, FIG. 3F shows the shape of frame 300, which is depicted by a dashed line, to be another shape that is different from a corresponding portion of panel base 101, which is depicted by a solid line.

Figure 4C:
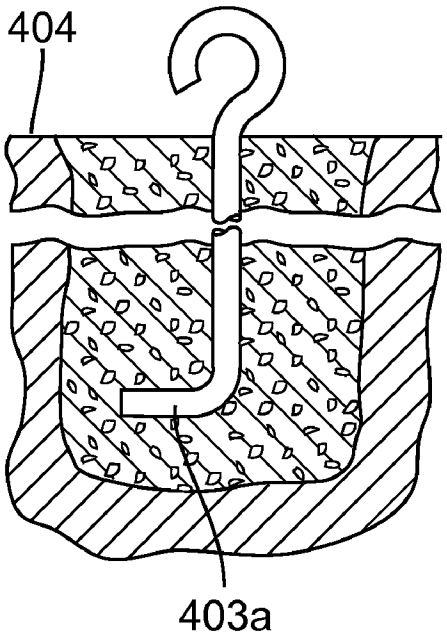
FIGS. 4A-4C depict exemplary embodiments of a ground attachment device for minimizing movement of a recreational structure during use and during weather events.
Figure 4B:
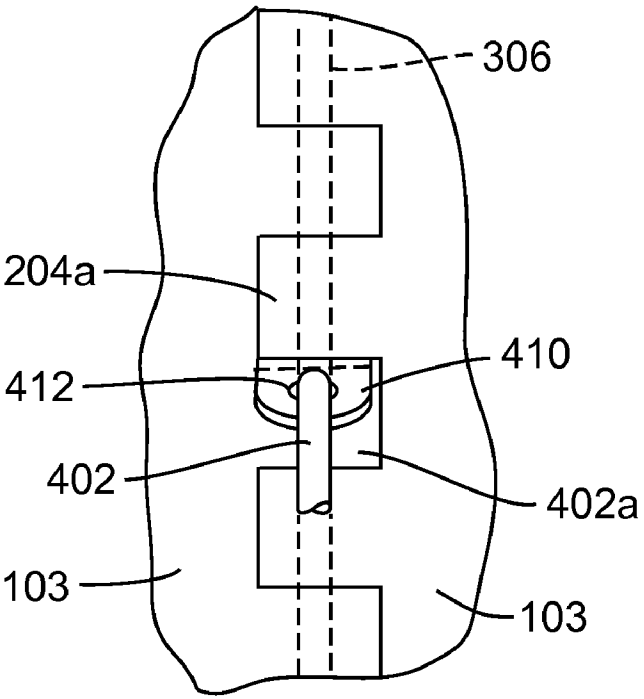
Figure 4A:
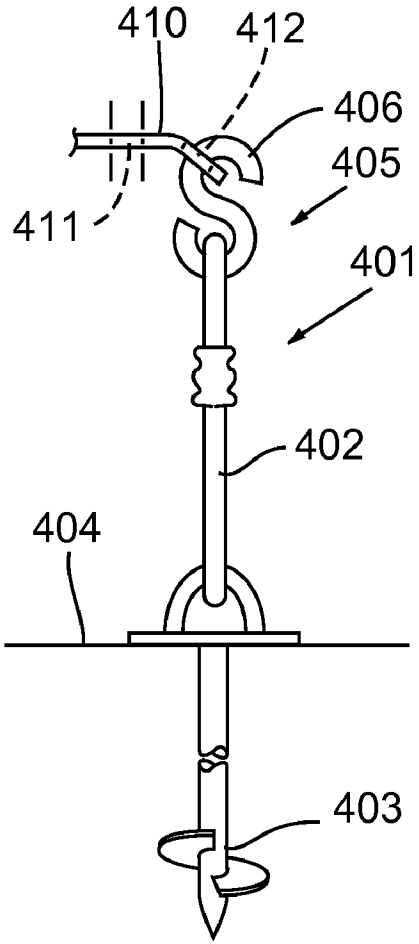

FIG. 4A depict an exemplary embodiment of a ground attachment device 400 for minimizing movement of a recreational structure during use and during weather events. Ground attachment device 400 comprises a ground anchor device 401 and an attachment accessory 410, which is also shown in FIG. 4B. Ground attachment device 400 may be disposed at locations internal to an assembled panel base of a recreational structure. Ground anchor device 401 comprises a drive shaft 402 having a screw end 403 that can be screwed into the ground 404 and a hook end 405 that remains above ground when the ground anchor device 401 is screwed to the ground 404. In one exemplary embodiment, hook end 405 comprises a hook device 406, such as an S-link. FIG. 4C depicts an exemplary alternative configuration for a screw end 403*a*. Attachment accessory 410 comprises a tab member 411 that is disposed between two vertically adjacent extensions 202*a* and 204*a* of two adjacent panels 103. Attachment accessory 410 comprises a first aperture 411 through which a carriage connector pin 306 can pass and a second aperture 412 through which a hook end 405 can be hooked. It should be understood that attachment accessory 410 could be arranged in an alternative configuration and ground anchor device 401 could be coupled to attachment accessory 410 is a corresponding manner for coupling ground anchor device 401 to attachment accessory 410.

Figure 5:
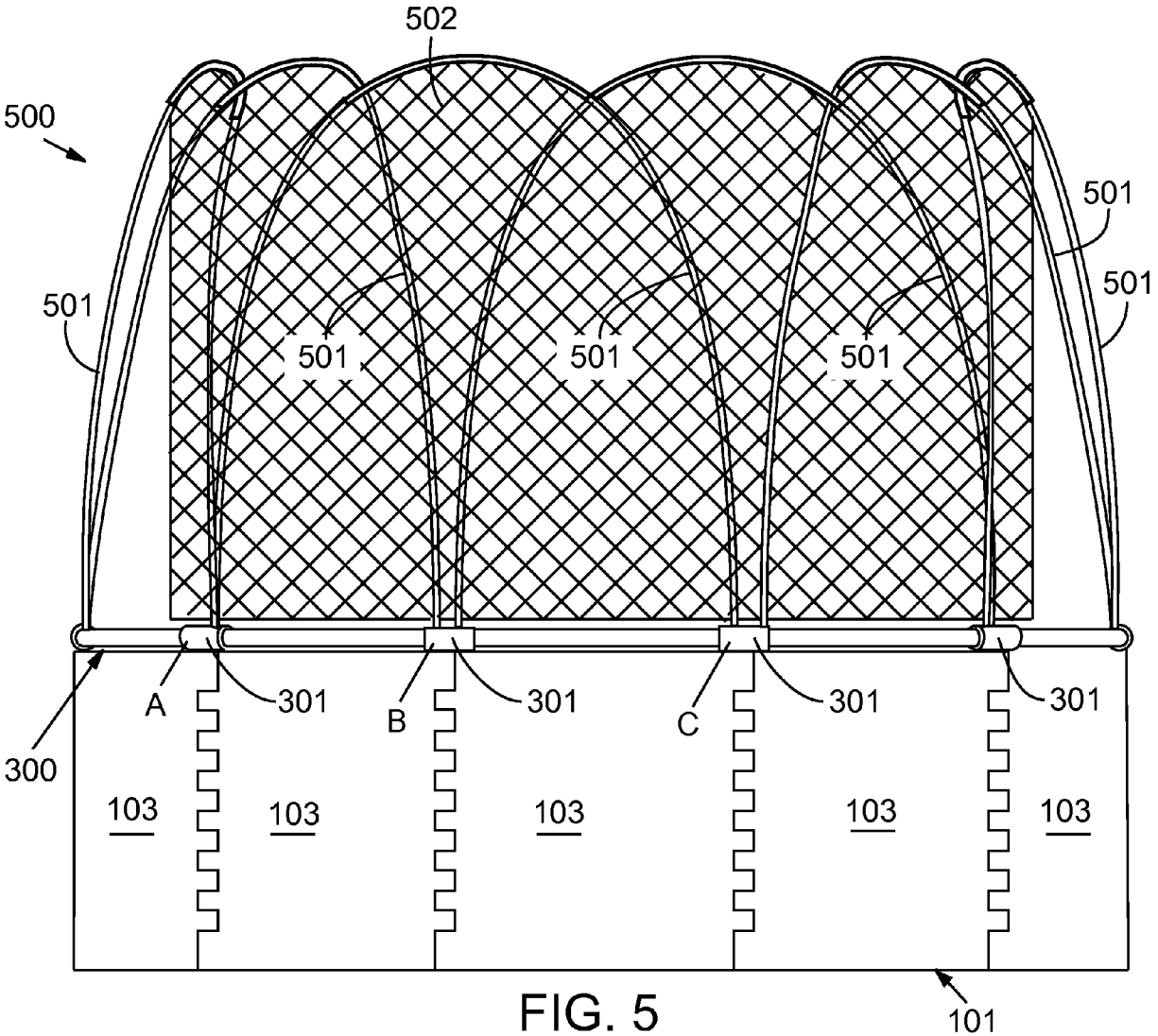
FIG. 5 depicts an exemplary embodiment of a safety enclosure according to the subject matter disclosed herein.

FIG. 5 depicts an exemplary embodiment of a safety enclosure 500 according to the subject matter disclosed herein. Safety enclosure 500 is designed to safely stop a user from falling from the rebounding surface of the recreational structure and operates as a fence around the rebounding surface, but does not act as a rebounder. Safety enclosure 500 comprises a plurality of flexible rods 501 that supports and suspends safety netting 502. One suitable flexible rod that could be used for flexible rod 501 is disclosed by U.S. Pat. No. 6,450,187 A1 to Lin et al., the disclosure of which is incorporated by reference herein. Safety netting 502 comprises a net or fabric mesh and a plurality of sleeves formed along a top edge of the netting in which a rod 501 can be inserted. When a rod 501 is inserted into a sleeve, the two ends of the rod extend out from the sleeve. The ends of each flexible rod 501 are then coupled to frame 300 by inserting each end into an aperture 304 (FIGS. 3A and 3B) of an angled-sleeve-joint coupling 301 so that the rod 501 forms an arch that spans between two angled-sleeve-joint couplings 301 that are spaced about by at least one angled-sleeve-joint coupling. For example, referring to FIG. 5, a rod 501 forms an arch that spans between the angled-sleeve-joint couplings located at point A and point C, while points A and C are spaced apart, in this case, by the single angled-sleeve-joint coupling located at B. The sleeve formed in flexible netting 502 is coupled to an arched flexible rod at least at a top portion of the arch formed by a flexible rod. The arrangement is repeated around the frame 300 so that adjacent flexible rods 501 overlap and provide lateral support to each other. In one exemplary embodiment, the number of flexible rods 501 equals the number of panels 103 forming a panel base 101. In another exemplary embodiment, the number of flexible rods 501 is a submultiple of the number of panels 103 forming the panel base. While flexible rods 501 are depicted in FIG. 5 has extending substantially vertically from frame 303, apertures 304 could be oriented and the size of the top of the safety netting at the sleeves is such that flexible rods 501 bow outward from frame 300 before bowing back in at the top of the safety netting. Additionally, safety netting 502 comprises a door arrangement (not shown) for allowing entry into the area enclosed by safety enclosure 500.

Figure 6B:
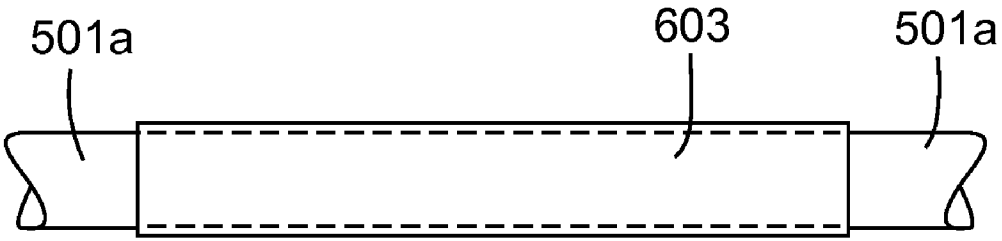
FIGS. 6A-6C depict exemplary embodiments of ferrules that can be used with a flexible rod that forms the safety enclosure of FIG. 5.
Figure 6C:
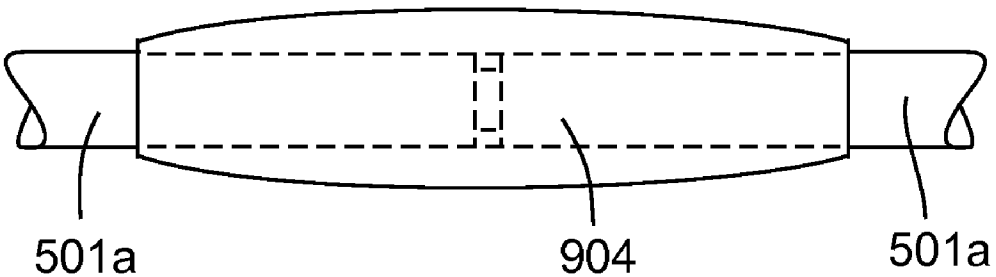
Figure 6A:
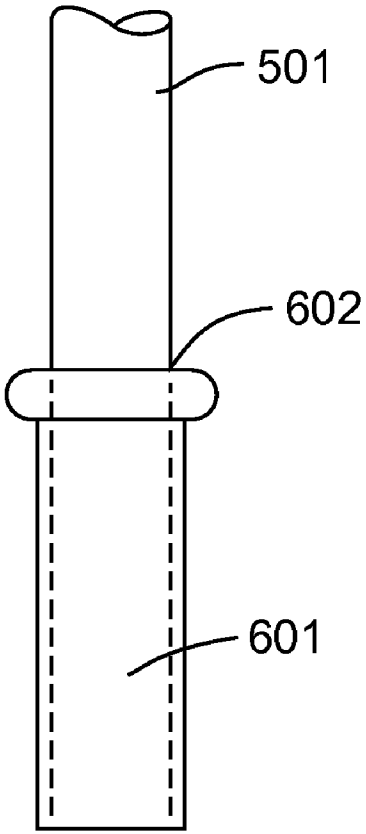

In one exemplary embodiment, a flexible rod 501 comprises a ferrule 601 disposed at each end of the rod, such as shown in FIG. 6A. The size of ferrule 601 is selected so that it can be inserted into an aperture 304 of a sleeve-joint coupling 301. One exemplary embodiment of a ferrule 601 comprises an integrated stop flange 602 for preventing the flexible rod from being inserted too far into aperture 304. Further, in one exemplary embodiment, flexible rod 501 can be formed from one piece. In an alternative exemplary embodiment, a flexible rod 501 can be formed from a plurality of shorter flexible members 501*a* (FIGS. 6B and 6C). When flexible rod 501 is formed from a plurality of flexible members 501*a*, the flexible members 501*a* can be fastened together using rigid connector ferrules, such as shown in FIGS. 6B and 6C. FIG. 6B shows one exemplary embodiment of a rigid connector ferrule 602, and FIG. 6C shows an alternative exemplary embodiment of a rigid connector ferrule 603. When flexible rod 501 comprises a coated fiberglass rod, the jacket material of the fiberglass rod forming the coated portion should be removed if ferrule will be crimpled or glued.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A trampoline, comprising:

a rebounding-surface frame comprising a closed shape;

a rebounding surface coupled to the rebounding-surface frame;

a first panel disposed between the rebounding-surface frame and a support surface, the first panel comprising a top edge, a bottom edge and a body portion extending between the top edge and the bottom edge, at least a portion of the top edge of the panel being coupled to at least a portion of the rebounding-surface frame, and the body portion of the panel comprising at least one aperture configured as a game target, the game target comprising a ortion of agoalie's net a portion of a throw and return s stem a portion of a throw and hold system, a portion of a flying disk targeting game, a flexible material disposed in the aperture, or combinations thereof;

a second panel disposed between the rebounding-surface frame and the support surface, the second panel comprising a top edge, a bottom edge and a body portion extending between the top edge and the bottom edge, the body portion comprising an aperture and a door disposed within the aperture; and a plurality of flexible rods, each flexible rod comprising a first end and a second end, the rebounding-surface frame comprising at least four apertures arranged in a first through fourth sequential arrangement along the frame assembly, each aperture capable of receiving an end of a flexible rod, the first end of a first flexible rod being received by the first aperture and the second end of the first flexible rod being received by the third aperture, and the first end of the second flexible rod being received by the second aperture and the second end of the second flexible rod being received by the fourth aperture, the first and second flexible rods each forming an arch shape between the apertures receiving the respective ends of the first and second flexible rods.

2. The trampoline according to claim 1, further comprising a ground attachment device coupled to at least one panel, the ground attachment device being capable of being coupled to the ground.

3. A trampoline, comprising:

a rebounding-surface frame comprising a closed shape;

a rebounding surface coupled to the rebounding-surface frame;

a plurality of panels, at least a first panel being disposed between the rebounding-surface frame and a support surface, the first panel comprising a top edge, a bottom edge and a body portion extending between the top edge and the bottom edge, at least a portion of the top edge of the first panel being coupled to at least a portion of the rebounding-surface frame, and the body portion of the first panel comprising at least one aperture configured as a game target, the body portion of at least one of the plurality of panels comprises at least one aperture, the at least one aperture being configured as a game target, the game target comprising a portion of a goalie's net, a portion of a throw and return system, a portion of a throw and hold system, a portion of a flying disk targeting game, a flexible material disposed in the aperture, or combinations thereof; and a second panel disposed between the rebounding-surface frame and the support surface, the second panel comprising a top edge, a bottom edge and a body portion extending between the top edge and the bottom edge, the body portion comprising an aperture and a door disposed within the aperture.

4. The trampoline according to claim 3 , further comprising a ground attachment device coupled to at least one panel, the ground attachment device being capable of being coupled to the ground.

* * * * *